US006700046B2

(12) United States Patent
Cherbettchian

(10) Patent No.: US 6,700,046 B2
(45) Date of Patent: Mar. 2, 2004

(54) SNARE-SWITCH MECHANISM CONNECTED TO THE SNAREBAND OF A SNARE DRUM

(76) Inventor: Wahan Cherbettchian, Ludwig-Strecker-Strasse 9, Mainz (DE), D-55129

( * ) Notice: Subject to any disclaimer, the term of this patent is extended or adjusted under 35 U.S.C. 154(b) by 0 days.

(21) Appl. No.: 10/124,947

(22) Filed: Apr. 18, 2002

(65) Prior Publication Data

US 2002/0178895 A1 Dec. 5, 2002

(30) Foreign Application Priority Data

Jun. 1, 2001 (DE) ..... 101 26 914

(51) Int. Cl.[7] ..... B10D 13/02
(52) U.S. Cl. ..... 84/415
(58) Field of Search ..... 84/415, 411 R, 84/417, 413

(56) References Cited

U.S. PATENT DOCUMENTS

| | | | | |
|---|---|---|---|---|
| 1,458,905 A | | 6/1923 | Leedy | |
| 1,892,223 A | | 12/1932 | Sansone et al. | |
| 2,621,554 A | | 12/1952 | Way | 84/415 |
| 3,264,927 A | | 8/1966 | Fischetti | 84/411 |
| 4,383,467 A | * | 5/1983 | Glassford, Jr. | 84/415 |
| 4,383,521 A | * | 5/1983 | Bounds | 126/616 |
| 4,630,521 A | * | 12/1986 | Alletto | 84/413 |
| 6,020,547 A | | 2/2000 | Chen | 84/415 |
| 6,177,620 B1 | | 1/2001 | Alulyan | 84/415 |

FOREIGN PATENT DOCUMENTS

| | | |
|---|---|---|
| DE | 1227319 | 10/1966 |
| DE | 4321745 | 1/1995 |
| GB | 490988 | 8/1938 |
| GB | 841771 | 7/1960 |

* cited by examiner

*Primary Examiner*—Kimberly Lockett
(74) *Attorney, Agent, or Firm*—Michael L. Dunn

(57) ABSTRACT

The invention submitted pertains to a snare-switch mechanism for the snareband (2) of a snare drum (25), whereby one end of the snareband (2) is essentially fixed and the other end is connected to an adjusting mechanism (1), which is movable between a tightened position where the snareband (2) touches the bottom (24) of the drum and a loosened position. In order to create a snare-switch allowing for production of a much broader spectrum of drum tones during a musical piece, an adjusting mechanism (1) is provided with apparatus which can be pressed by a musician's thigh or knee, so that the snareband (2) can be gradually adjusted between tight and loose positions.

14 Claims, 7 Drawing Sheets

SNARE-SWITCH MECHANISM CONNECTED TO THE SNAREBAND OF A SNARE DRUM

BACKGROUND OF THE INVENTION

The following invention applies to a snare-switch mechanism for the snareband of a snare drum, whereby one end of the snareband is essentially attached to the drum, while the other end is attached to a snare-switch, allowing for movement between a tightened (snareband touching the bottom of the drum) or a loosened position of the snareband.

Such a mechanism is standard equipment on a snare drum. The snareband consists of many parallel rows of thin metal chains, which when tightened, produce a light rattling and hard metallic sound when the drumhead is hit. When the snareband is loosened, a much duller sound is made. Depending upon the desired timbre—either hard metallic or duller drum tone—the snare-switch which is normally mounted on the side of the drum is used to tighten or loosen the snareband on the bottom of the snare drum. Usually, a bar attached to a lever which has two stable end positions is switched up or down, allowing the changeable end of the snareband to either tighten or loosen against the drum bottom, depending upon the position of the snare-switch. The other end of the snareband is essentially attached, "essentially" meaning that the fixed end can also be adjusted, for example to be able to fine-tune the tension of the snareband. This adjusted position is however generally kept at its setting, as opposed to the snare-switch, which can be switched to its two positions during a musical piece to create either the hard metallic or duller drum tone on the snare drum, as desired.

Apart from the fine-tuning adjustment positions of the essentially-attached end of the snareband, which are only done occasionally, and cannot generally be changed quickly (for example during a musical piece), the musician or drummer only has the choice between two drum tones; hard metallic or dull, since the lever on the snareband has only two different and stable end positions.

BRIEF DESCRIPTION OF THE INVENTION

Proceeding from this technical situation, this invention has been devised in order to produce a snare-switch which allows for producing a much broader spectrum of drum tones during a musical piece.

This problem has been solved by creating a pedal device attached to the snare-switch end which, through knee or thigh contact, can be gradually pressed with more or less strength, in order to utilize all the drum sounds between the usual two fixed settings.

Due to this device used to gradually position the snareband, it is now possible to produce a smooth transition between the hard metallic and dull drum sounds, because the snareband can be loosened gradually until it barely touches the bottom of the snare drum and finally is completely detached, and vice versa. In practical terms, this is done by attaching the loose end of the snareband to a swivel-mounted lever on an axle-shaft, the swivel axle of which is flush with the snareband and running perpendicular to its length, whereby the snareband, or rather its extension, passes through the swivel axle and pulls the lever to the stop when pressure is applied.

Hereby the end of the snareband or its extension does not have to be directly attached to the lever. The lever can be attached to a straight-moving sliding carriage, which can itself be attached to the snareband.

The inventive idea is applicable to all kinds and types of snare-switches, regardless of whether they are moved by a knee-pedal, a sliding carriage, cable tackles, any other moving device or a combination thereof.

When there is direct contact between the pedal and the snareband it is furthermore useful when the swivel axle radius of the lever runs through dead-center whether in a tightened or loosened position, whereby the knee-pedal through its knee or thigh contact can be held in any desired position.

More particularly the invention is a snare switch mechanism for a snareband of a snare drum. The mechanism includes a snare switch and an adjusting apparatus where one end of the snareband is attached to the drum and another end is attached to the snare switch. The mechanism thus is able to move the snareband between a tightened first position where the snareband is tight against a bottom of the drum and a second loosened position of the snareband where it is out of contact with the bottom of the drum. The snare switch is connected to the adjusting apparatus which is moveable by a knee or thigh of a musician to permit the snareband to be gradually adjusted between its tightened and loosened positions.

DETAILED DESCRIPTION OF THE INVENTION

In a preferred embodiment, a dead-center point lies near the stopping point of the tightened position. In this manner, the dead-center point can be reached very quickly when the lever is pressed, by which the tightest possible tension can be produced, leaving the entire spectrum of the swivel-axle at full disposal in order to produce a continuous transition of drum sounds.

For ease in usage, it is practical to keep the tension for the tightened position of the lever or its spring-switch mechanism in place by a recoil spring.

Additionally, it is intended that in a preferred embodiment of this invention, at least when a recoil spring is in place, that while in a loosened position, the switch mechanism can be locked in place. In case the loosened position of the snareband is preferred, the locking device would keep it in place without the necessity of using the switch mechanism. This locking device could also be incorporated on the thigh/knee pedal device.

A most preferred version of this invention is that in which the snare-switch is mounted on the snare rim. The bottom snare rim serves to stabilize and stretch the bottom drum skin and is already a standard part on every snare drum. While generally snare-switches are mounted on the side or wall of the drum, the advantage of mounting the snare-switch mechanism on the snare rim is that the sound of the snare drum is no longer affected by the built-on switch.

Naturally, the counterpart piece for the adjustable end of the snareband is also mounted to the bottom snare rim and constructed accordingly.

Regarding the attachment on the snare rim, or alternatively to an integrated bracket on a snare rim, reference may be had to German patent application number P43 21 745.1, which involves the attaching of snare switches on snare rims. The aforementioned invention may be combined in its entirety with the presently considered invention, although the snare-switch mechanism could also be used regardless of the mounting location.

Further advantages, characteristics and forms of application are clearly shown in the description and drawings.

Figure 1:
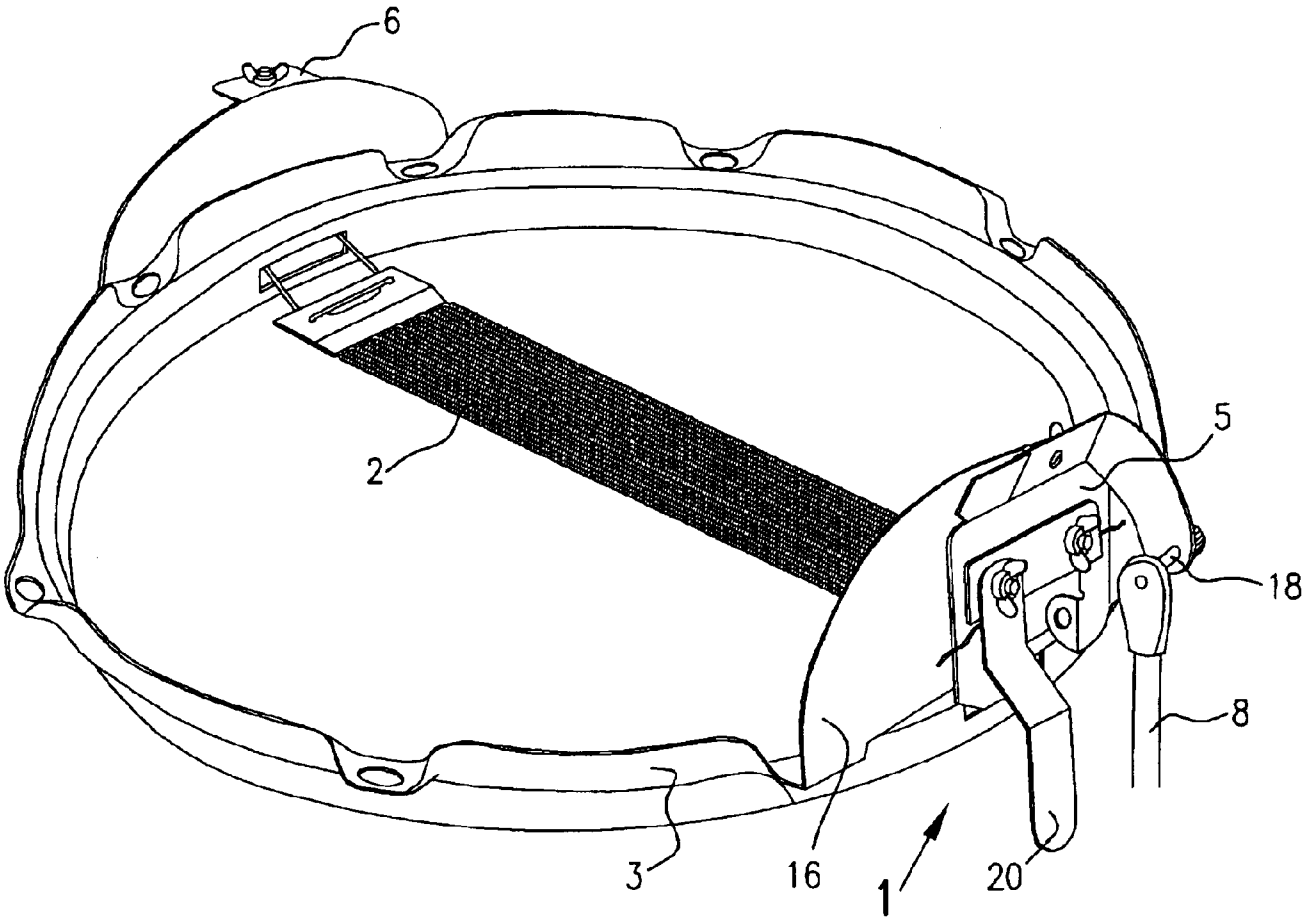
FIG. 1 shows a drum rim with snare-switch and its knee or thigh pedal.

FIG. 1 shows a bottom drum rim (3) which in cross-section has a quasi z-shaped form and which goes around the bottom of a snare drum. Regularly spaced around the circumference of the rim are outwardly-bent flanges with openings through which mounted tension-rods run, which are connected to lugs which are generally placed at exact points around the drum. The bottom edge of drum rim (3) exhibits two diametrically-opposed slits, through which the snareband (2) extensions run. On the opposite side of the drum rim (3) one can see the part of the attaching device (6) used to hold the fixed end of the snareband (2) in place, and at bottom right the snare-switch mechanism (1) for the snareband (2). The snare-switch mechanism (1) consists of a lever (5) which is on a swivel-axle joint (7) (usually a pair of such joints on a single axis) and a spring is connected to stop (10), which controls the tightness of the snareband, meaning whether or not and with what force the snareband touches the bottom drumskin.

In FIG. 1 there is an additional fixed knee pedal attached to a lever (5), which can be pressed by the musician's knee or thigh so that the lever (5) can make a smooth transition from the illustrated tightened snareband (2) position to a loosened one. Extension pole (8) for a foot pedal application is not part of this invention. Knee pedal (20) is attached by a propeller screw to a lever (5) and can also be detached.

Figure 2:
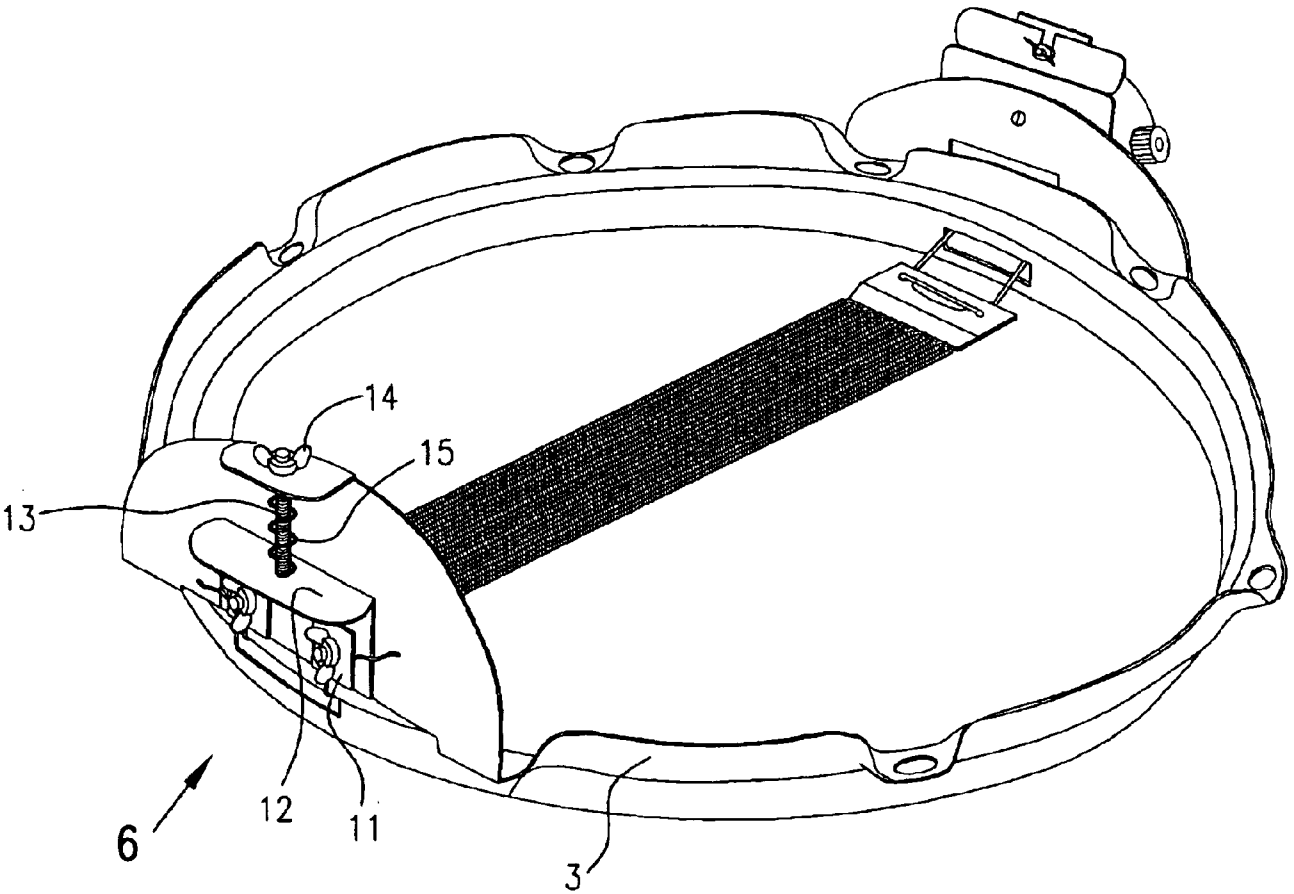
FIG. 2 shows a drum rim with snareband with a view of the fixed-end of the snareband.

In FIG. 2, the same drum rim is shown from the opposite side, in order to show the mounting device on the fixed side of the snareband (2). As shown, snareband (2) is attached to a sliding device (12) with the aid of a clamp and two propeller screws which is itself tightly connected to the tension rod (13). The tension rod (13) can be adjusted by a propeller screw.

A spring (15) pushes sliding device (12) away from the metal holding plate of the propeller screw (14). With the aid of a propeller screw (14), the sliding device (12) can be pulled up against the resistance of the spring (15) toward the mount, in order to control the tension of the snareband (2) by the pedal (5).

Figure 3:
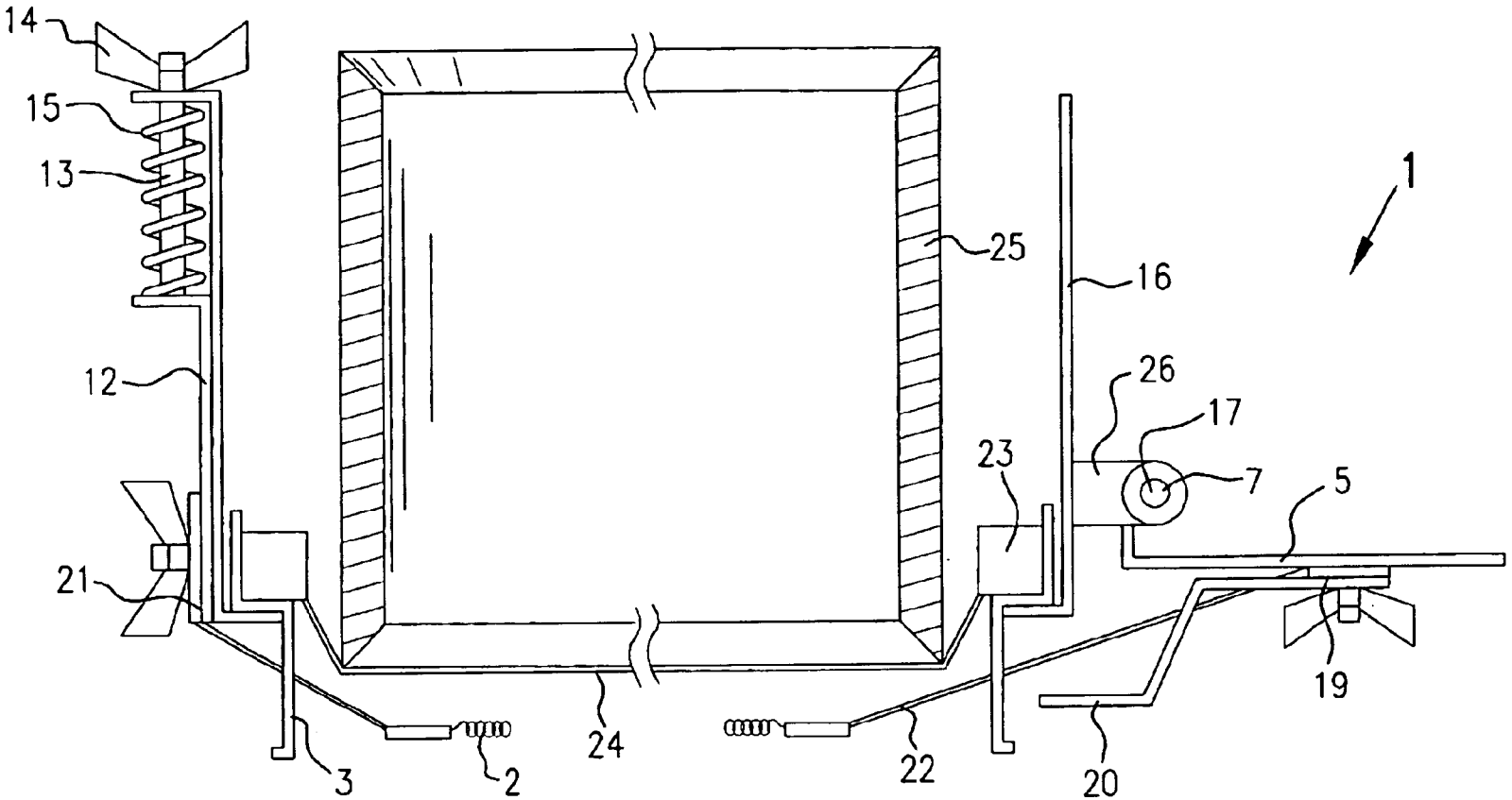
FIG. 3 is a diagrammatic longitudinal cross-sectional view of a drum and the snare-switch mechanism.
Figure 4:
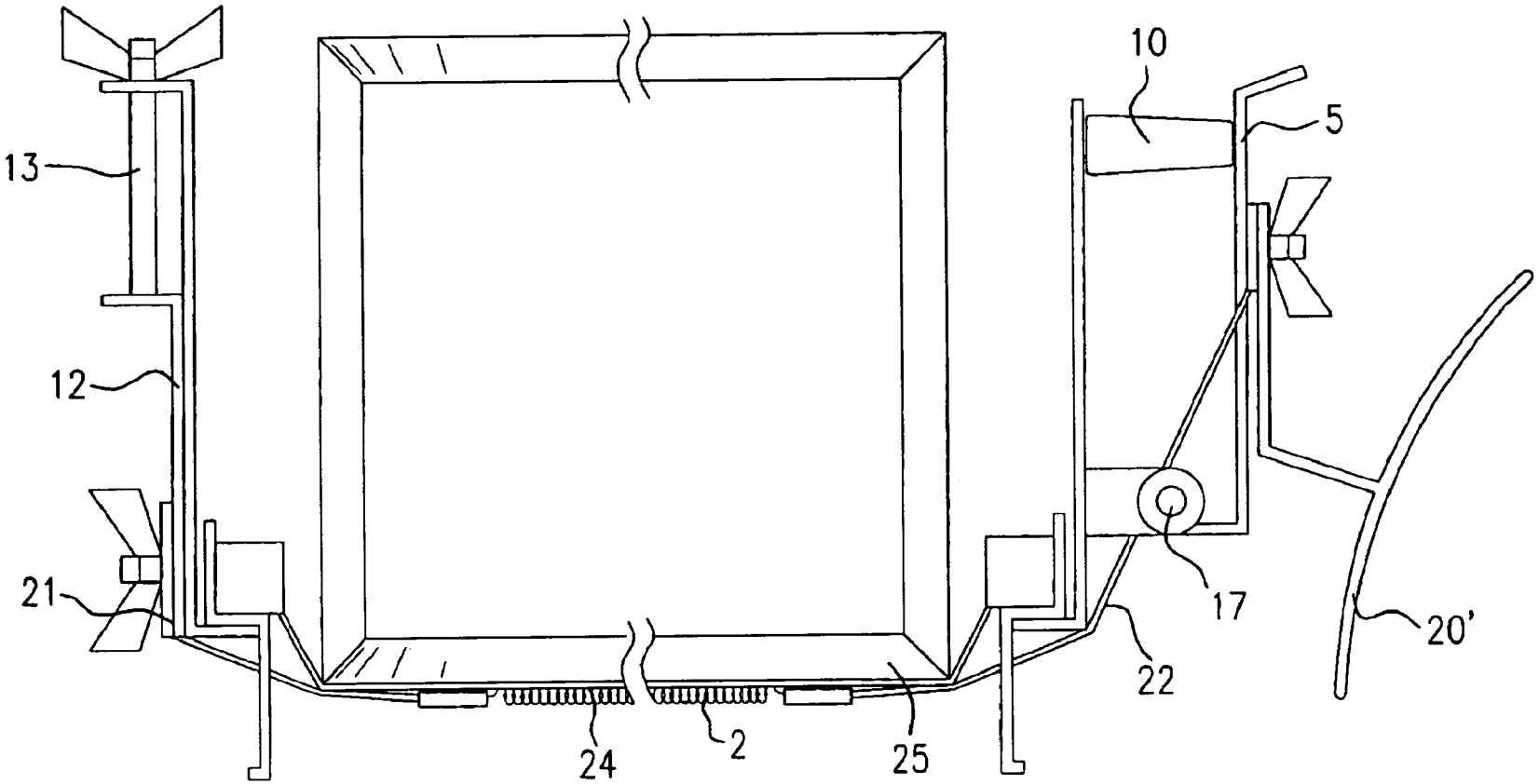
FIG. 4 shows a similar cross-section as in FIG. 3, but with the snareband in the tightened position and with an alternative knee pedal variation.

The functional principle of various lever mechanisms is shown even more clearly in FIGS. 3 and 4. In FIG. 3 lever (5) of the switch mechanism (1) is in the loosened position so that the snareband (2) accordingly hangs loosely at a distance from the bottom drumskin (24) of the snare drum (25). (23) is a fastening ring for the bottom drumskin (24). A supporting corner (16) is attached to "z-form" drum ring (3), illustrated in cross-section, which can also be integrated in one piece onto the drum ring (3). Stretching from the supporting corner or angle iron (16) are two joints (26) with a hole through which a joint pin (7) runs, ending in a movable axle (17). Axle (17) shown in FIG. 4 as running perpendicular to the plane of the paper, runs therefore parallel to the plane of the bottom drumskin (24) (and snareband (2)) and perpendicular to the pulled length of the snareband (2). The left end of the snareband (2), or more exactly the left-sided extension thereof, shown in FIG. 4, is fastened to a holding clamp (21), which itself is attached to a vertically-movable sliding device (12). As can be seen in FIG. 4, the sliding device (12) is vertically moveable due to an adjusting propeller screw (14), whereby the spring (15) is used to stretch the sliding device (12) downwards.

Figure 7:
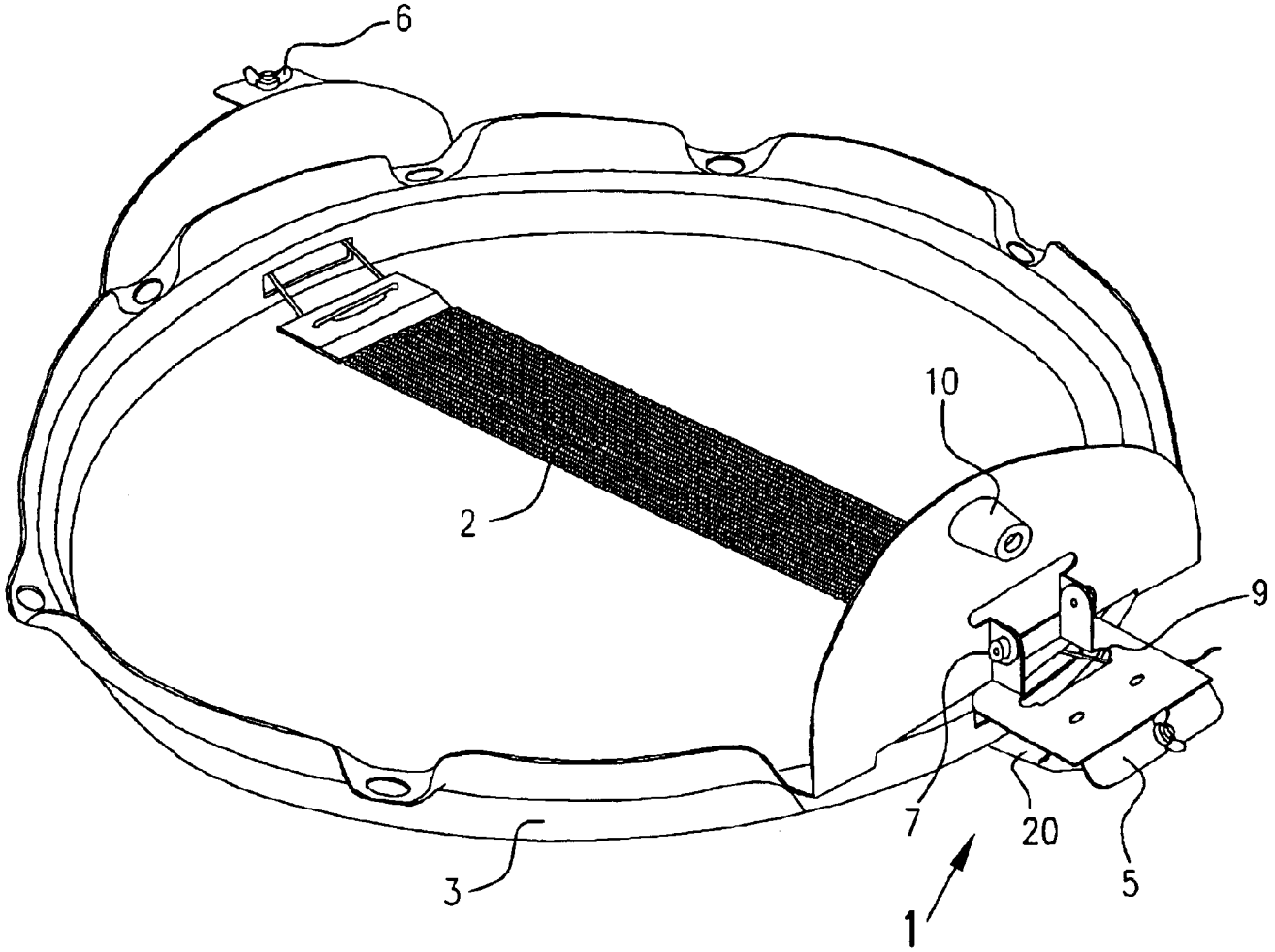
FIG. 7 shows the embodiment as seen in FIG. 5, but with a tightened snareband.

On the opposite side of the drum (25), a lever (5) has been swivel-mounted through a pivot or axle shaft (7) to the axle (17). At the same time, on the lever (5) there is a clamp device (19) for the movable extension end (22) of the snareband (2). As can be seen, in this case, meaning in the removed or loosened position of the snareband (2), the extension (22) of this snareband passes well beneath the axle (17) on an axis and in clear distance thereof, so that in the case of tightening the snareband (2) or its extension (22), it pulls the lever (5) to its lowered position, where it is practical to install a stop for the lever (5). A recoil spring cocks the lever (5) back into the upper position as can be seen in FIG. 7 at (9). This recoil spring is generally made so strong that it can overcome any possible stretching tension from the snareband (2) and can always bring the lever (5) back to the tightened position, wherein the loosened position shown in FIG. 4 (and FIG. 7) is itself adjustable, i.e. may be maintained stationary.

FIG. 4 shows the snareband (2) in its tightened position, whereby it touches the bottom drumskin (24) of the drum (25). The lever (5) rests in this position against the stop (10) and irregardless of the unshown recoil spring is also stretched against the stop due to the snareband (2), since the extension part (22) of snareband (2) is now passing above the axle (17), and therefore correspondingly exerts torque on the lever (5) towards the stop (10).

In the illustration according to FIG. 4, there is an alternative style of push pedal shown, which can be actively moved in either direction by the thigh or knee, so that in this design, a recoil spring is unnecessary.

Figure 5:
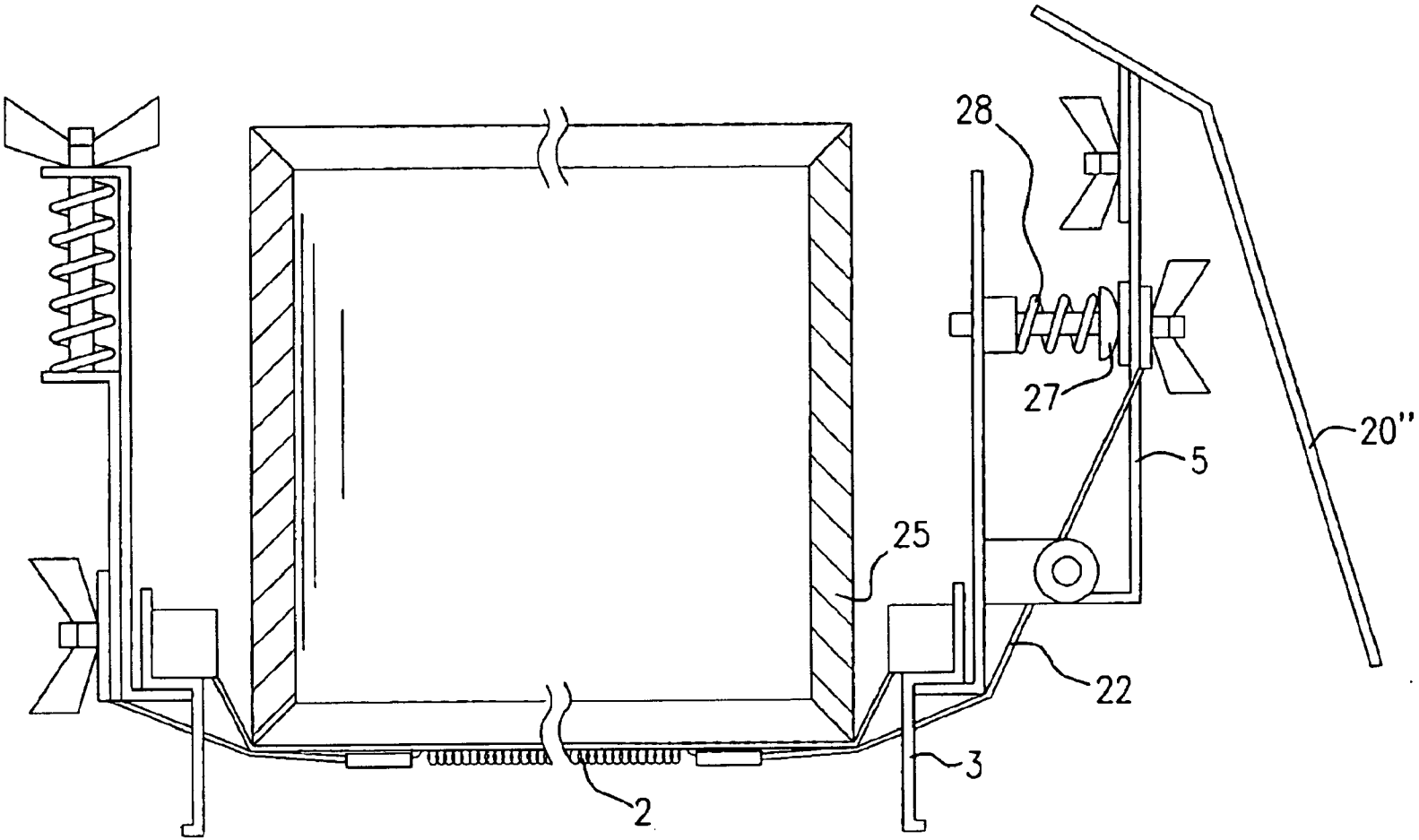
FIG. 5 shows a similar cross-section as in FIG. 4, but with another alternative knee pedal variation.
Figure 6:
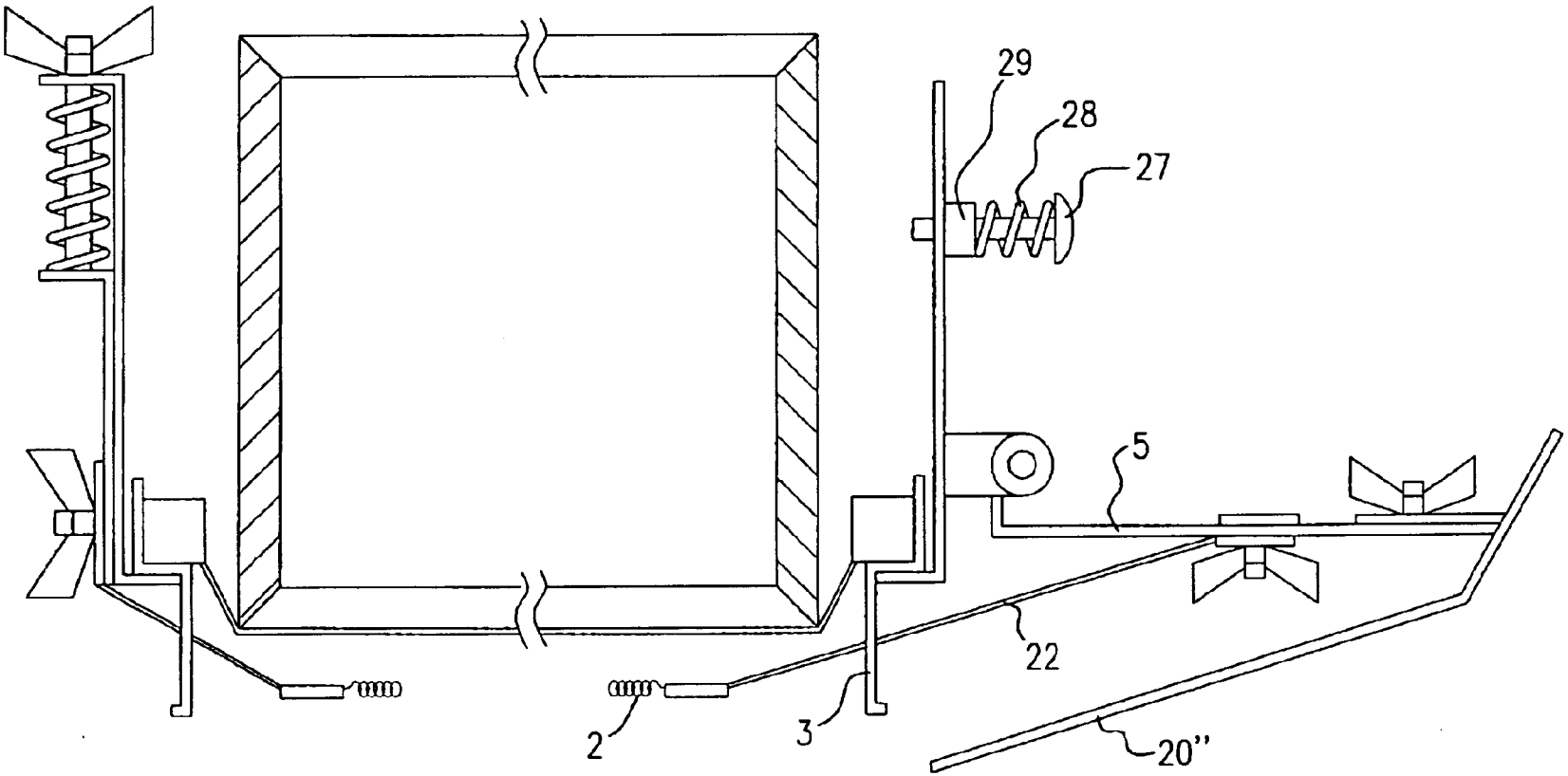
FIG. 6 shows a drum rim similar to FIG. 1, but with the snare switch in the loosened position.

FIGS. 5 and 6 show a drum with a further variation of a lever (20) activated by a musician's thigh or knee which in this case is a convexly-bent lever (20). In order to loosen the snareband (2) from the position in FIG. 5, the bottom end of the lever (20) is pushed to the left by the knee or thigh. In FIG. 6, the upper end of the lever (20) is also pushed to the left, by means of which it is swung upwards again.

In the embodiment shown in FIGS. 5 and 6, there is shown an adjustable stop member 27 in the form of an adjustment screw which is prestressed by a spring (28), which spring (28) serves to keep the threads in tight engagement so that the screw (27) does not become loosened upon vibrations of the drum during use. Further, an additional check nut (29) may be provided to keep adjustable screw (27) in an adjusted position.

As can be seen in FIG. 5, screw (27) may be adjusted in a manner that the extension (22) of snareband (2) passes the axle (17) in a over-center position and, if desired, may be adjusted such that the extension (22) almost crosses the axle (17) in the position, where lever (5) abuts the stop member (27). This means that, regarding the bias exerted by the snareband (2) and the extension (22) thereof, the lever (5) is very close to the dead-center or over-center position when the snareband is tightened and lever (5) abuts stop member (27).

FIG. 7 again shows a drum rim very similar as the one shown in FIG. 1, wherein, however, the snare-switch mechanism is shown in the open or loosened position.

What is claimed is:

1. A snare switch mechanism, for a snareband (2) attached at a first end to a snare drum (25), said snare switch mechanism comprising a snare switch (1) and an adjusting apparatus (4, 20), said snare switch being attachable to the snare drum and to a second end of the snare band, for moving the snareband between a tightened first position where the snareband is tight against a bottom (24) of the drum, and a second loosened position of the snareband where it is out of contact with the bottom of the drum, said snare switch being connected to the adjusting apparatus (4, 20) which is moveable by a knee or a thigh of a musician to permit the snareband (2) to be gradually adjusted between its tightened and loosened positions, a pivotable lever (5) of the snare switch mechanism being attachable to an adjustable extended end (22) of the snareband (2), which in turn is pivotably connected to a frame element (16) at an axle (17), which axle runs parallel to a plane of the snareband (2) and perpendicular to a length of snareband (2), so that when pivotable lever (5) is moved to pass through a longitudinal axis of axle (17) it pulls lever (5) against a stop (10) to tighten the snareband (2) against a surface of the drum.

2. A snare switch according to claim 1 wherein lever (5) can be held in any desired position by a knee or thigh within a pivotable range of lever (5) and when snareband (2) is tightened or loosened, lever (5) passes through a dead center position such that lever (5) is self retaining when against stop (10).

3. A snare switch mechanism according to claim 2 wherein the dead center position is near a stop point of lever (5) when against stop (10) in a tightened position.

4. A snare switch mechanism according to claim 1 wherein lever (5) is biased by a spring (9) in a direction of a tightened position.

5. A snare switch mechanism according to claim 1 wherein a pedal (20, 20') moveable by thigh pressure, is attached to lever (5).

6. A snare switch mechanism according to claim 1 wherein an adjustably-sliding device (12) is fastened to a fixed end (21) of a snareband (2).

7. A snare switch mechanism according to claim 1 wherein it is directly attached to a bottom drum rim of a snare drum.

8. A snare switch mechanism according to claim 5 wherein a pedal (20, 20') is shaped in a concavely or convexly bent form to permit comfortable movement by a musician's knee.

9. A snare switch mechanism according to claim 1 wherein means are provided for stable resting positions permitting the snareband to be retained at any point between end positions.

10. A snare switch mechanism according to claim 1 mountable upon a support plate that is attachable to a kettle drum wall.

11. A snare switch mechanism according to claim 1 mountable upon a support plate that is attachable to a lug attached to a drum.

12. A snare switch mechanism according to claim 1 mountable upon a support plate that is attachable to a drum rim of a snare drum.

13. The snare switch mechanism of claim 1 attached to a snare drum.

14. The snare switch mechanism of claim 12 attached by its support plate to a drum rim of a snare drum.

* * * * *